United States Patent [19]

Laithwaite

[11] 4,033,398

[45] July 5, 1977

[54] METHODS OF MANUFACTURING LAMINATED METAL STRIP BEARING MATERIALS

[75] Inventor: Eric Roberts Laithwaite, Ditton Hill, England

[73] Assignee: Vandervell Products Limited, England

[22] Filed: Feb. 27, 1976

[21] Appl. No.: 662,243

[52] U.S. Cl. ..... 164/49; 164/86; 164/98; 164/146; 164/250; 164/268; 164/DIG. 2; 427/47

[51] Int. Cl.[2] ..... B22D 11/16; B22D 27/02

[58] Field of Search ..... 164/49, 86, 98, 147, 164/250, 267, 268, DIG. 2; 427/47

[56] References Cited

UNITED STATES PATENTS

| | | | |
|---|---|---|---|
| 2,022,571 | 11/1935 | Palm et al. | 164/86 |
| 3,467,166 | 9/1969 | Getselev et al. | 164/49 |
| 3,518,109 | 6/1970 | Holley | 427/47 |
| 3,605,865 | 9/1971 | Getselev | 164/250 |
| 3,735,799 | 5/1973 | Karlson | 164/47 |

FOREIGN PATENTS OR APPLICATIONS

| | | | |
|---|---|---|---|
| 2,060,637 | 6/1971 | Germany | 164/49 |

*Primary Examiner*—Ronald J. Shore
*Attorney, Agent, or Firm*—Edward F. Connors

[57] ABSTRACT

A layer of metal is cast on a surface of a metal backing and while the cast metal is still molten, a varying electromagnetic force is generated along an edge of the strip which induces electric currents in the molten metal. The resulting mechanical force exerted in the molten metal is such that the metal is restrained from flowing to the edge of the strip.

13 Claims, 3 Drawing Figures

METHODS OF MANUFACTURING LAMINATED METAL STRIP BEARING MATERIALS

BACKGROUND OF THE INVENTION

1. Field of the Invention

This invention relates to methods of manufacturing laminated metal strip and is particularly although not exclusively applicable to the manufacture of strip bearing material.

2. Description of the Prior Art

It is usual that the edge portions of the strip are wasted when bearings are eventually formed from the strip and so to avoid wasting the relatively expensive bearing metal, it is necessary to recover the bearing metal from the scrap so formed. It has been proposed to prevent the bearing metal from flowing to the edge portions of the strip by treating the edge portions with an anti-wetting agent so that only the relatively cheap backing layer is wasted before bearings are formed from the strip. The present invention seeks to provide an alternative method of achieving the same results.

It is known that liquid metal can be moved and subjected to mechanical pressure by the induction of electric currents in the liquid by means of primary coil systems fed from supplies of alternating current. The known art includes arrangements for the suspension and melting of metals in vacuo without a crucicle and for the pumping of liquid metal from the cores of nuclear reactors.

SUMMARY OF THE INVENTION

The invention provides a method of manufacturing a laminated metal strip comprising casting on a metal backing a layer of a molten further metal and whilst the further metal is still molten, causing an alternating current to flow in a conductor to generate along at least one edge of the backing a varying magnetic field which causes electric current to flow in the molten layer which current interacts with the field to restrain the flow of molten metal adjacent said edges of the strip.

DESCRIPTION OF THE PREFERRED EMBODIMENTS

Figure 1:
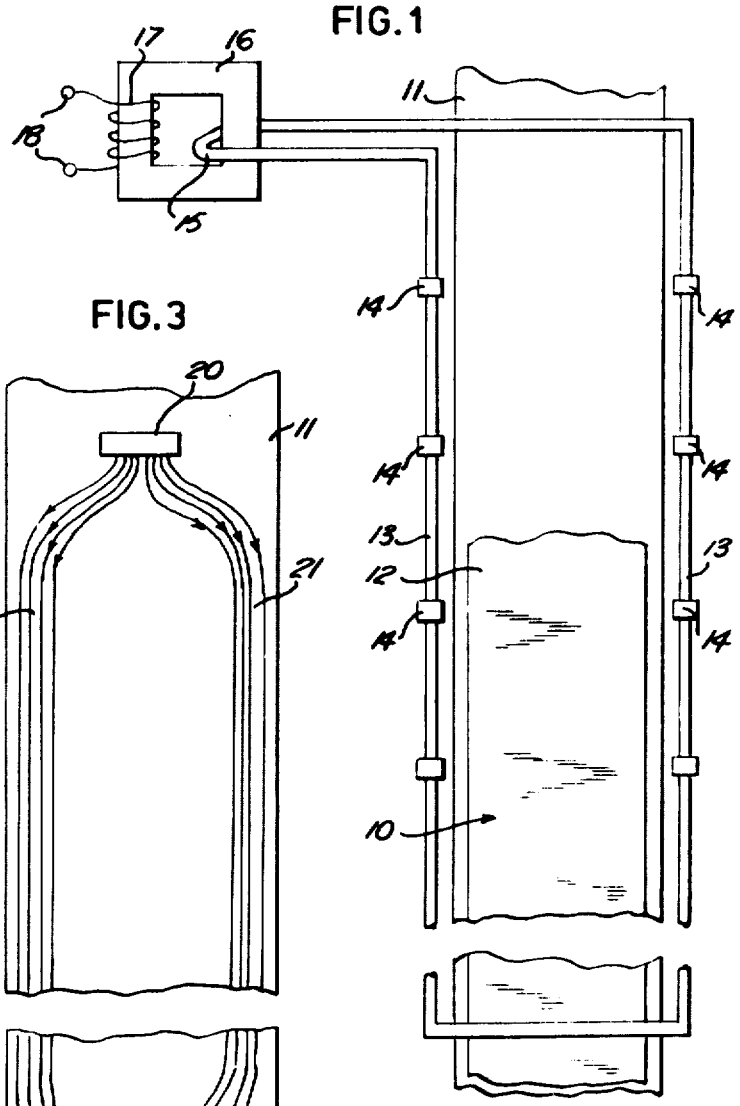
FIG. 1 is a plan view of a laminated strip in manufacture.

The drawings show a casting apparatus for the manufacture of a laminated metal strip suitable for bearings. The apparatus comprises a casting station for the metal to form the bearing layer of the laminated strip which is located in the region indicated at 10 under which a steel backing 11 is fed continuously by drive means (not shown). A layer of the molten bearing metal formed on the backing in the casting operation is indicated at 12.

To restrain the molten metal along the side edges of the backing parallel lengths of wire 13 are mounted along either side of the backing 11 in the region of the casting station and are supported in ceramic beads 14. The wires are connected in a circuit which constitutes the secondary 15 of a current transformer 16 having a primary winding 17 provided with in-put terminals 18.

The terminals 18 are connected to a source of alternating current and the transformer provides a large step-up in the current flowing between the primary and secondary windings.

The alternating current flowing in the wires 13 produces a varying electro-magnetic field in the molten metal 12 on the strip and the variation in the field induces electric current to flow in the molten metal. A repulsive force arises between the electromagnetic field and the currents flowing in the molten metal which repels the molten metal from the wires 13 and thus repels the molten metal from the side edges of the metal backing. The alternating current is arranged to repel the molten metal sufficiently to leave marginal portions of the backing un-coated with the molten bearing metal. Thus when the bearing metal has solidified, the marginal side edges of the backing remain un-coated so that scrap metal formed by the cutting away of the marginal edge portions in the manufacture of bearings from the strip does not result in the waste of expensive bearing metal.

The wires 13 may be formed from steel held initially in tension in which case the working temperature of the apparatus would be above the Curie point, thus avoiding skin effect in the conductors.

In a further embodiment of the invention, the wires 13 may be formed from thin hollow tubes which may be of copper and which may be cooled by gas or liquid flow through the tubes to carry away excessive heat.

Figure 3:
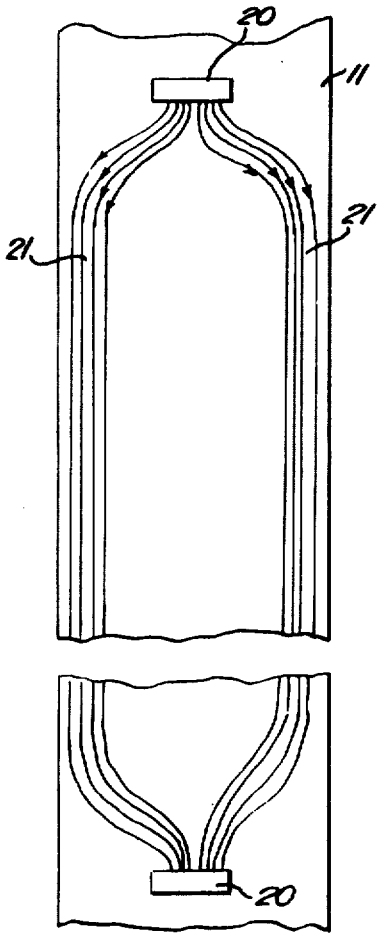
FIG. 3 shows an alternative manner of the manufacture of a laminated strip.
Figure 2:
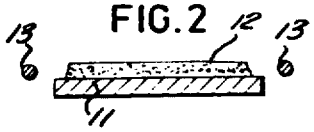
FIG. 2 is a sectional view of the arrangement of FIG. 1.

In a further embodiment illustrated in FIG. 3 the edges of the backing 11 itself are used to replace the wires 13. This is arranged by utilizing the known effects of alternating current whereby such current has a preference for flowing in the surface layers of a conductor of substantial cross-section due to the increased flux linkages of current flowing at a depth. The effect is known as "Skin effect" As shown in FIG. 3, the ends of the strip 11 are made to complete an electric circuit via collector brushes 20 connected in the circuit which constitutes the secondary of a current transformer similar to the current transformer 16 of the first embodiment. At a suitable frequency, the current flows in lines 21 in the metal backing 11. Molten metal poured onto the surface of the metal backing from a casting station as described in FIG. 1 would be prevented from flowing to the marginal edges of the backing by repulsion between the currents in the metal backing and the induced electric currents in the molten metal.

The casting apparatus and methods described above are particularly applicable to the casting of bronze bearing metal onto a steel back.

I claim:

1. A method of manufacturing a laminated metal strip comprising casting on a metal backing strip a layer of molten further metal and while the further metal is still molten causing alternating currents to flow in both the metal backing and the molten further metal such that the phase of the alternating currents changes progressively from at least one edge of the metal backing strip so as to produce a travelling magnetic field that restrains flow of molten metal adjacent the said edge of the strip by interaction between the induced currents and the said moving magnetic field.

2. A method as claimed in claim 1 wherein the magnetic field generated is arranged to restrain the flow of molten metal to a location spaced from the edge of the strip to leave a marginal portion of the strip uncoated with the further metal.

3. A method as claimed in claim 1 wherein the currents flowing in the metal backing and the molten metal are set up inductively by the provision of a single conducting wire parallel to and adjacent the said edge or both edges of the strip, said conducting wire being fed with alternating current.

4. A method as claimed in claim 3 wherein the conductor comprises a secondary winding of a current transformer having a primary winding for connection to a source of alternating current and the arrangement being such that there is a step-up in current between the primary and secondary windings.

5. A method as claimed in claim 1 wherein the currents flowing in the metal backing and the molten further metal are introduced conductively by electrical contacts engaging with the surface of the metal backing, the contacts being connected to a single phase supply of alternating current.

6. A method as claimed in claim 5 wherein the contacts are connected in a circuit that includes the backing strip, the molten further metal and a secondary winding of a current transformer having a primary winding for connection to a source of alternating current and the arrangement being such that there is a step-up in current between the primary and secondary windings.

7. A method as claimed in claim 1 wherein the metal backing strip is moved continuously through a casting station where the molten metal is cast onto the strip and varying magnetic fields are generated along both sides of the backing at the casting station to restrain the molten metal on the backing.

8. A method as claimed in claim 1 wherein the varying magnetic field is generated in the or each side edge of the strip where the flow of molten metal is to be restrained by passing an alternating current therethrough.

9. An apparatus for performing the method of claim 1 comprising a casting station for casting on a metal backing a molten further metal, a source of alternating current and a conductor connected to said source to cause alternating currents to flow in both the metal backing and molten further metal.

10. An apparatus as claimed in claim 9 wherein a conductor connected to the source of alternating current is provided along the or each side edge of the strip where the molten metal is to be restrained.

11. An apparatus as claimed in claim 9 wherein the source of alternating current is connected by contacts to the metal backing to provide a flow of current to the or each side edge of the backing where the molten metal is to be restrained.

12. An apparatus as claimed in claim 9 wherein means are provided for passing the metal backing continuously past the casting station and the means for generating a varying magnetic field are arranged to generate varying magnetic fields along both side edges of the field at the casting station to restrain the molten metal adjacent both side edges of the strip.

13. An apparatus as claimed in claim 9 wherein the source of alternating current is connected to the metal backing to provide a flow of current to the or each side edge of the backing where the molten metal is to be restrained.

* * * * *